United States Patent [19]

La Porte

[11] Patent Number: 4,596,413

[45] Date of Patent: Jun. 24, 1986

[54] APPARATUS FOR PICKING UP ELONGATED, IRREGULAR SHAPED OBJECTS OR LITTER

[76] Inventor: Allen R. La Porte, 240 Jones Rd., Kerrville, Tex. 78028

[21] Appl. No.: 744,247

[22] Filed: Jun. 13, 1985

[51] Int. Cl.[4] ..... A63B 57/00

[52] U.S. Cl. ..... 294/19.1; 294/19.2; 294/61

[58] Field of Search ..... 294/19.1, 19.2, 61, 294/50, 50.5, 50.6, 24, 2, 10, 14, 20, 33, 19.3, 87.1, 87.26; 56/328 R

[56] References Cited

U.S. PATENT DOCUMENTS

| | | | |
|---|---|---|---|
| 2,367,105 | 1/1945 | Donaldson | 294/61 |
| 3,258,286 | 6/1966 | Coward | 294/19.2 |
| 3,807,154 | 4/1974 | Moore | 294/19.2 |
| 3,982,781 | 9/1976 | Tucker et al. | 294/19.2 |

*Primary Examiner*—James B. Marbert
*Attorney, Agent, or Firm*—Gunn, Lee & Jackson

[57] ABSTRACT

An apparatus for picking up elongated irregular shaped objects, such as beverage cans and/or bottles, is shown. A lightweight housing is provided with an opening at an upper and a lower end thereof. Parallel springs extend across the lower opening to receive cans and/or bottles therethrough and to hold them inside the housing. A pivotal handle across the upper opening allows for ease of removal of collected refuse. A litter pickup stick is removably mounted on a side of the housing. As paper is picked up with the litter pickup stick, it can be removed by a notch in the upper opening of the housing, and the paper litter is maintained separate from solid objects, such as bottles and cans, by a pivotal gate inside the housing. The housing is of sufficient length to pick up refuse without bending.

8 Claims, 5 Drawing Figures

APPARATUS FOR PICKING UP ELONGATED, IRREGULAR SHAPED OBJECTS OR LITTER

BACKGROUND OF THE INVENTION

The present invention relates to an apparatus for picking up elongated irregular shaped objects and, more particularly, to a hand carried apparatus that may be used in picking up beverage cans and/or bottles or other litter without stooping or bending by the user.

DESCRIPTION OF THE PRIOR ART

Prior to the present invention, many different types of devices have been used to pick up items without stooping or bending. For example, a litter pickup stick has been used by individuals carrying a bag to pick up items that stick to a point of the litter pickup stick for many years. A primary source of litter other than paper is beverage cans or bottles. However, a little pickup stick is not suitable for picking up cans or bottles. Also beverage cans or bottles may be recycled and used against thereby constituting a source of income.

Numerous items have been designed in the past to pick up symmetrical objects, such as golf balls, as can be seen in a number of golf ball retrieval/dispensing devices as listed hereinbelow:

| U.S. PAT. NO. | ISSUE DATE | INVENTOR |
|---|---|---|
| 2,706,657 | 4/19/55 | Talley |
| 3,149,872 | 9/22/64 | Ward |
| 3,186,593 | 6/02/65 | Miotke |
| 3,206,067 | 9/14/65 | Smith |
| 3,412,897 | 12/26/67 | Slater |

All of these patents require that the object being picked up be symmetrical. None of these devices can be used to pick up irregular objects, such as cans or bottles, without bending or stooping.

Applicant has not seen a device for picking up irregular shaped objects, such as beverage cans or bottles, without bending or stooping. The reason why no such devices have been offered for sale in the marketplace is because they are either impractical to use or expensive to build. There is no question that a need exists for a device that can pick up irregular shaped objects, such as cans or bottles, as well as other common litter, such as paper.

SUMMARY OF THE INVENTION

It is an object of the present invention to provide an apparatus for picking up irregular shaped objects without bending or stooping.

It is another object of the present invention to provide an apparatus that may be used to pick up irregular shaped objects, such as beverage cans or bottles, without bending or stooping while simultaneously retaining the items picked up inside of a storage compartment.

It is still another object of the present invention to provide an economical lightweight device for picking up irregular shaped objects, such as beverage cans or bottles without bending or stooping by simply pressing resilient springs over irregular shaped objects.

It is still another object of the present invention to provide springs over a lower opening of a housing through which irregular shaped objects, such as beverage cans or bottles, may be inserted by the stretching of the springs, or paper litter may be picked up by a pointed stick and inserted through the top.

It is still another object of the present invention to provide an apparatus that may be used for both the picking up of litter (such as paper) and the picking up irregular shaped objects (such as beverage cans or bottles) without the necessity of bending of stooping and at the same time maintaining paper litter separate from rigid, solid litter, such as beverage cans or bottles.

An elongated rectangular shaped housing has an open upper end and an open lower end. A pivotal handle extends over the open upper end and is pivotally connected to the sides of the housing. The handle also includes a tab means for slidably mating with a slot in the top of the housing to maintain the handle in a fixed position unless pivotal motion of the handle is desired by the user.

At least a pair of parallel springs extend across the lower opening in the elongated housing for connection to opposite sides thereof. The springs are spaced and sized so that when an individual places the springs generally parallel and over a can or bottle and pushes down, the can or bottle will spread the springs and be received into the housing. The springs have sufficient resiliency to thereafter maintain the can or bottle inside the housing. While any number of springs can be used, applicant presently envisions the use of two springs. Also the width of the lower opening can be any width desired; however, it is presently envisioned that the width be sufficient to accomodate beverage cans or bottles therebetween.

Connected to an external side of the housing is a litter pickup stick having a sharp projectile on the lower end thereof. The litter pickup stick is mounted on the outside of the housing by means of a clip at the upper end thereof and by means of a plate with a hole in the plate through which the sharp projectile extends. The sharp projectile simply holds the lower end of the pickup stick in position and the upper end of the litter pickup stick is clipped into position. A notch is provided in the upper part of the housing so that paper or other litter picked up on the sharp projectile of the litter pickup stick can be raked off inside of the housing.

Inside of the housing near the mid-portion thereof is located a gate that is pivotably attached at one side of the housing. On the other side of the housing is an abutment so that the gate may rest in a position generally parallel with the plane for the springs. The gate is free to pivot upward, but cannot pivot down below the abutment. This allows for beverage cans or bottles to be inserted into the lowermost portion of the apparatus and, if necessary, to pivot the gate upward into the upward portion. This can also serve to separate paper litter from beverage cans or bottles.

For durability, the lower opening on the housing has a rim therearound which can be formed by simply rolling the lower part of the housing. Also the upper opening in the housing may be reinforced by a rim extending therearound. While the handle may be mounted by any suitable means, it is envisioned that a spacer is necessary around the pivot access to separate the handle from the sides of the housing. The pivot access is then anchored to the housing. Attachments to the housing, such as the pivot axis for the handle, may be made by any suitable means, such as welding. It may be necessary to reinforce the area of the housing where the handle attaches.

DESCRIPTION OF THE PREFERRED EMBODIMENT

Figure 1:
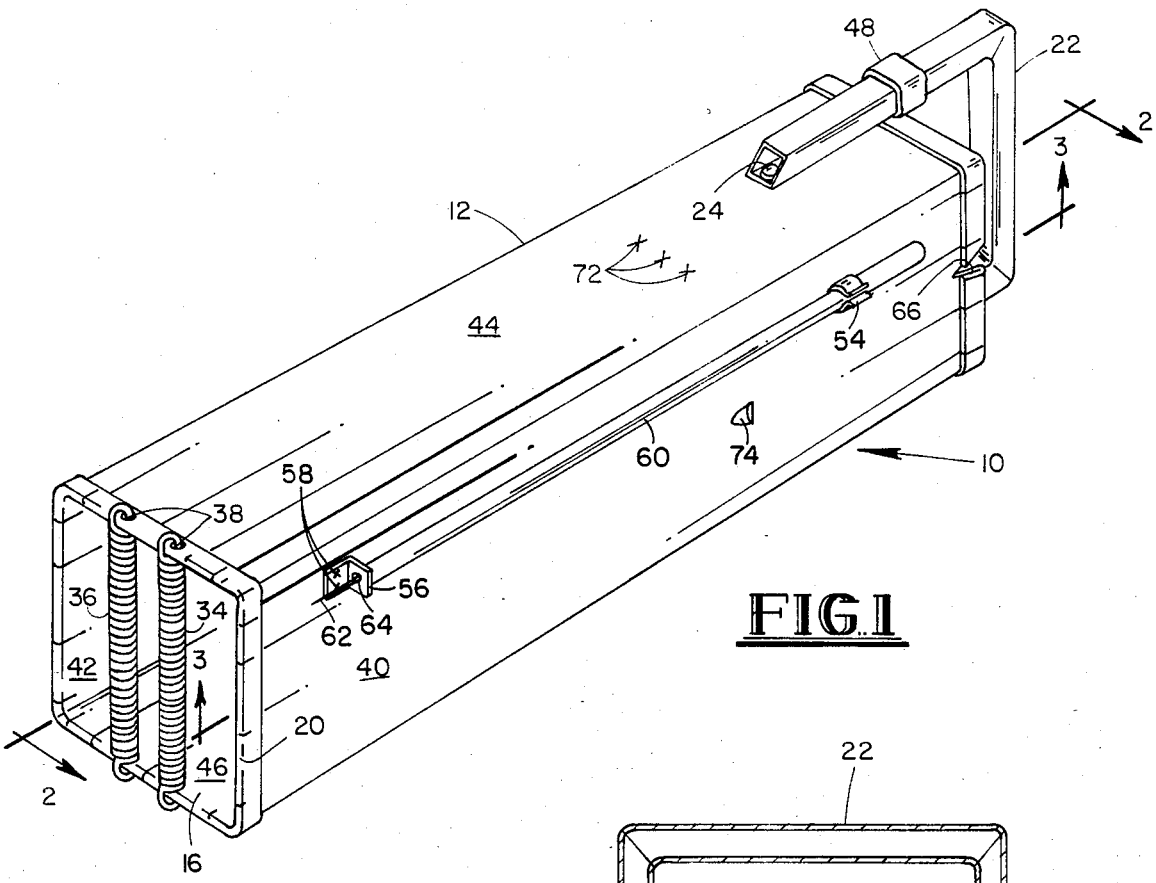
FIG. 1 is a perspective view of the invention.
Figure 2:
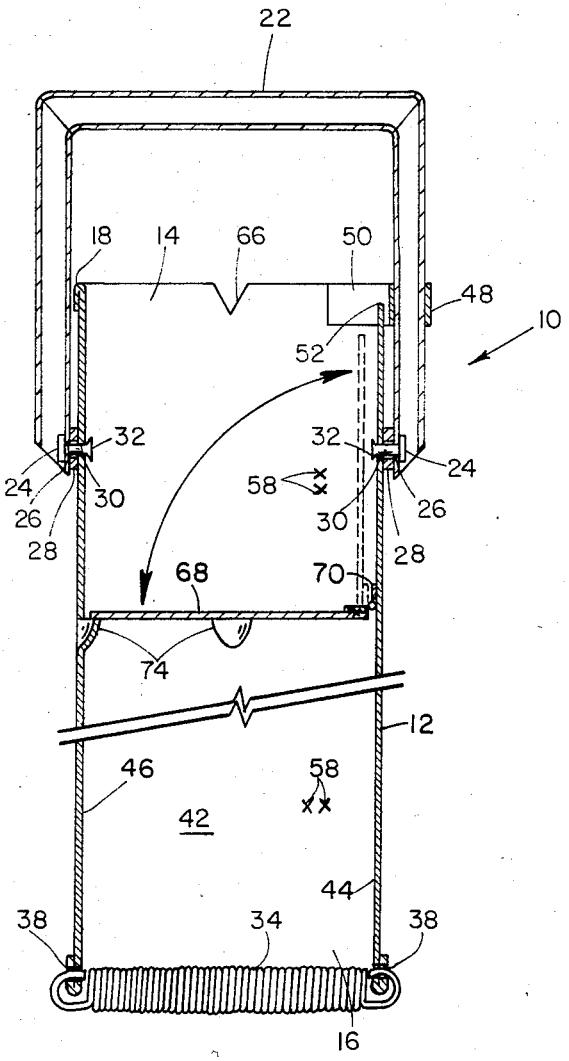
FIG. 2 is a sectional view of FIG. 1 taken along section lines 2—2.
Figure 3:
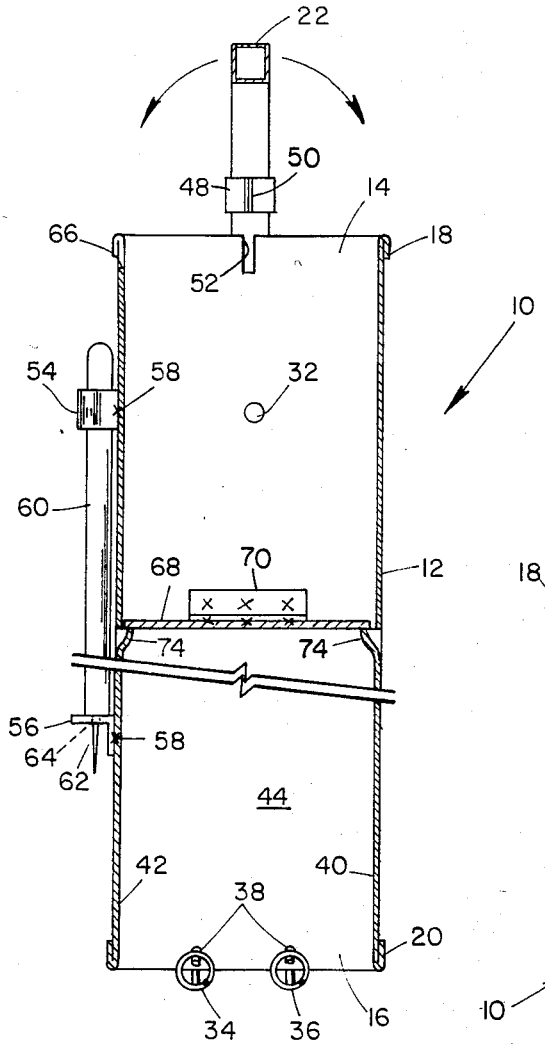
FIG. 3 is a sectional view of FIG. 1 taken along section lines 3—3.

Referring now to FIGS. 1, 2, and 3 in combination, an apparatus for picking up irregular shaped elongated objects or litter is shown as represented by reference numeral 10. The apparatus includes an elongated housing 12 that has a rectangular cross-sectional area. The elongated housing 12 may be tapered in from top to bottom, though the embodiment shown does not have a taper. The elongated housing 12 has an upper opening 14 and a lower opening 16 therein. The elongated housing 12 should be made from lightweight material, such as aluminum, and may have an upper rolled portion 18 around the upper opening 14 to provide additional strength. Likewise, a lower rolled portion 20 may be provided around the lower opening 16 to provide additional strength.

Pivotally connected above upper opening 14 is a handle 22. While any type of handle may be used, in this particular embodiment the handle is made from a rectangular tubular member. The handle 22 is pivotally mounted on each end thereof by bolts 24, which extend through a hole 26 in the lowermost portion of the handle 22, spacer 28 and hole 30 in the housing 14. On the inside of the housing 14, the bolt 24 may be secured by any particular means, such as a nut; however, in applicant's preferred embodiment, the bolt 24 is bradded inside of housing 14 to provide the minimum amount of interference with objects collected inside of housing 14. The brad 32 is illustrated in FIGS. 2 and 3. The spacer 28 prevents interference between the handle 22 and the housing 14.

Figure 5:
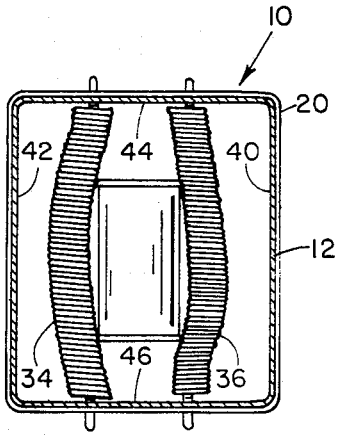
FIG. 5 is an enlarged cross-sectional view of FIG. 4 along section lines 5—5.
Figure 4:
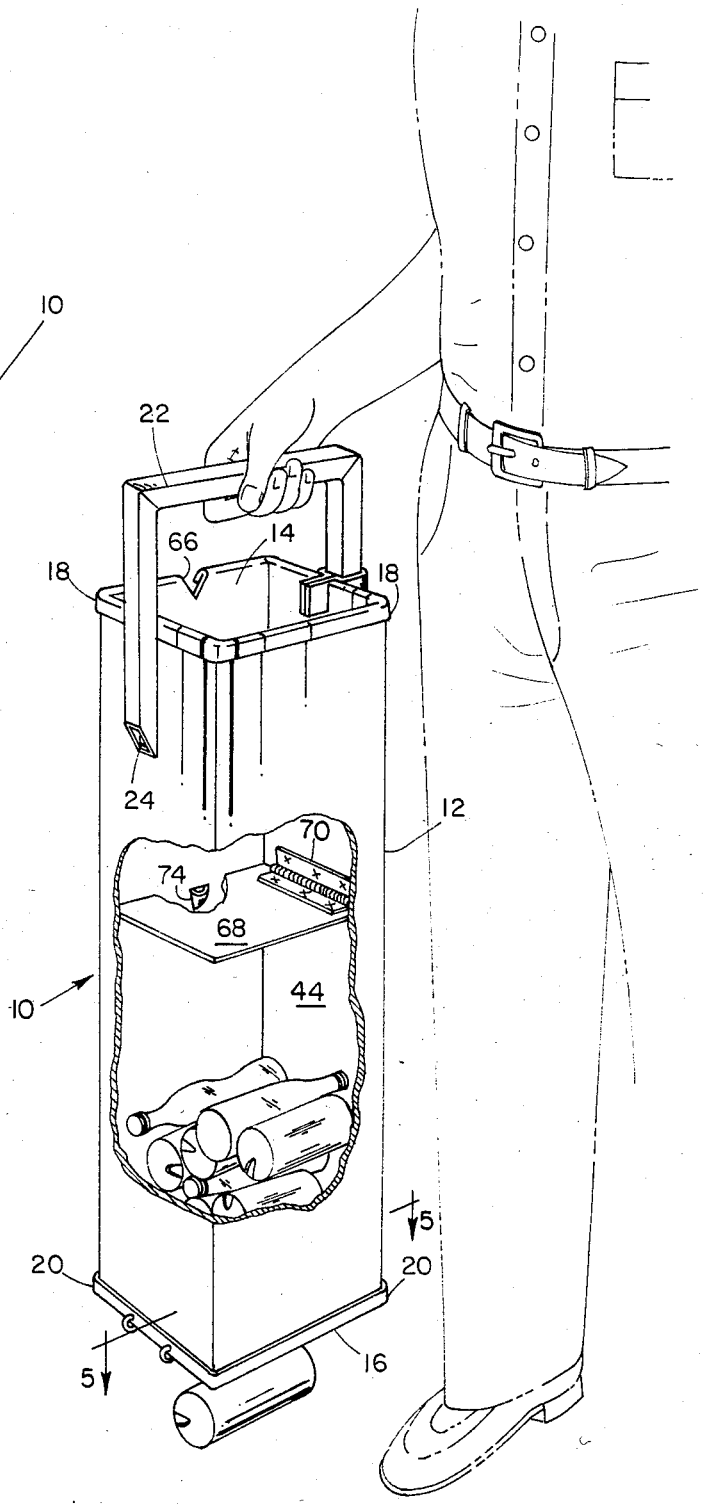
FIG. 4 is an enlarged perspective view of the invention in use with the user being shown in broken lines.

Extending across the lower opening 16 is a pair of parallel springs 34 and 36. The springs 34 and 36 are hooked on each side of the housing 14 through holes 38 located therein. The springs 34 and 36 should be spaced so they will expand over a typical beverage can or bottle as is illustrated in FIGS. 4 and 5, yet at the same time have sufficient elasticity to maintain the collected objects inside of the housing 14 as illustrated in FIG. 4. The spacing between the springs 34 and 36 and sides 40 and 42 is sufficient to prevent collected beverage cans and bottles from passing therebetween without downward force being applied as illustrated in FIG. 4. The distance between sides 44 and 46 is of sufficient length to accept the typical beverage can and bottle therein while in the elongated position as illustrated in FIG. 4. This distance can be increased or decreased as desired.

Located on the handle 22 on one side thereof is a rectangular telescoping member 48 that has an inwardly directed tab 50 on the inside thereof. The inwardly directed tab 50 is designed to be received in slot 52 in the upper opening 14. When the rectangular telescoping member 48 and inwardly directed tab 50 is in the position as shown in FIG. 2 or 4, the handle 22 cannot pivot. However, when the rectangular telescoping member 48 and inwardly directed tab 50 has been raised as illustrated in FIG. 3, the handle may pivot in the directions indicated by the arrow. While the handle 22 is in the position as illustrated in FIG. 2, downward force may be applied on the entire apparatus 10 as illustrated in FIG. 4 for picking up beverage cans or bottles.

Located on side 42 near the corner thereof is a clip 54 and a flange plate 56. The clip 54 and flange plate 56 are connected by any convenient means, such as welding, as represented by welding spots 58. A litter pickup stick 60 having a sharp protrusion 62 on the lower end thereof is provided for picking up litter, such as paper. By placing the sharp protrusion 62 through hole 64 in flange plate 56 and by pushing the litter pickup stick 60 against the clip 54, the clip 54 spreads to receive the litter pickup stick 60 and to retain it in position as illustrated in FIGS. 1 and 3. During use, when paper is picked up by the sharp protrusion 62 of the litter pickup stick 60, the paper may be raked off into the elongated housing 12 by means of notch 66 in upper opening 14.

Internally inside of the elongated housing 12 is mounted a gate 68 pivotally connected by hinge 70. The hinge 70 is located near the mid-point of the elongated housing 12 and are anchored in sides 44 and 46 by any suitable means, such as welding represented by welding spots 72. The gate 68 is free to pivot upward about hinge 70, but may not pivot downward below the horizontal position because of inward protrusions 74. During the collection of beverage cans and bottles or other litter, such as paper, the gate 68 operates in the manner as illustrated in FIGS. 2 and 4. In other words, the entire elongated housing 12 may be filled with beverage cans or bottles with the gate 68 simply pivoting upward, or the upper portion may be filled with litter, such as paper, picked up by the litter pickup stick 60.

For a better understanding of the operation of the springs 34 and 36 in receiving beverage cans or bottles, through the lower opening 16 inside of elongated housing 12, attention is directed to the perspective view of FIG. 4 and the enlarged cross-sectional view as shown in FIG. 5. As the user applies downward force on the handle 22, the springs 34 and 36 spread apart to allow the beverage can or bottle to be received therebetween. However, sufficient resiliency is provided in springs 34 and 36 so that once the force is released on the handle 22, the refuge as collected in elongated housing 12 will remain therein.

I claim:

1. An apparatus for an individual to pick up elongated irregular shaped objects, such as beverage cans or bottles, or other litter comprising:

an elongated housing having an open upper end and an open lower end, said open lower end of said elongated housing being of sufficient size to receive said beverage cans or bottles therethrough while said beverage cans or bottles are in an elongated position;

handle means pivotally connected across said open upper end of said elongated housing;

at least a pair of parallel springs extending across said open lower end of said elongated housing, said pair of parallel springs being anchored on each end thereof in a lowermost portion of said elongated housing on opposing sides of said open lower end, spacing between said parallel springs and sides generally parallel therewith being such to allow said parallel springs to stretch over said beverage cans or bottles located therebelow and generally parallel therewith upon applying a downward force by said individual through said handle means, said parallel springs having sufficient resiliency to maintain said beverage cans or bottles collected in said elongated housing after removing of said downward force;

tab means slidably located on said handle means for mating with a slot in an uppermost portion of said elongated housing to hold said handle means in an upright position until pivotal motion of said handle means is desired; and a gate pivotally mounted parallel to said springs near a mid-portion of and to one side of said elongated housing, an abutment to prevent pivoting of said gate below a first plane generally parallel with a second plane containing said springs, said gate allowing said elongated housing to be filled with said beverage cans or bottles or separating said litter above said gate from said beverage cans or bottles.

2. The apparatus as recited in claim 1 wherein said elongated housing is generally rectangular in cross-sectional area with said open lower end being generally rectangular.

3. The apparatus as recited in claim 2 further comprising holder means for holding a litter pickup stick therein on a side of said elongated housing, said elongated housing having a notch at said open upper end for removing said litter from said litter pickup stick.

4. The apparatus as recited in claim 3 wherein said holder means includes a clip connected to said elongated housing near said open upper end thereof for clipping to said litter pickup stick and a horizontal plate with a hole therein connected to said elongated housing near said open lower end thereof, a sharp projection of said litter pickup stick extending through said hole during periods of non-use of said litter pickup stick.

5. An apparatus for an individual to pick up elongated irregular shaped objects, such as beverage cans or bottles, or other little comprising:

an elongated housing having an open upper end and an open lower end, said open lower end of said elongated housing being of sufficient size to receive said beverage cans or bottles therethrough while said beverage cans or bottles are in an elongated position;

handle means pivotally connected across said open upper end of said elongated housing;

at least a pair of parallel springs extending across said open lower end of said elongated housing, said pair of parallel springs being anchored on each end thereof in a lowermost portion of said elongated housing on opposing sides of said open lower end, spacing between said parallel springs and sides generally parallel therewith being such to allow said parallel springs to stretch over said beverage cans or bottles located therebelow and generally parallel therewith upon applying a downward force by said individual through said handle means, said parallel springs having sufficient resiliency to maintain said beverage cans or bottles collected in said elongated housing after removing of said downward force;

tab means slidably located on said handle means for mating with a slot in an uppermost portion of said elongated housing to hold said handle means in an upright position until pivotal motion of said handle means is desired; and holder means for holding a litter pickup stick therein on a side of said elongated housing, said elongated housing having a notch at said open upper end for removing said litter from said litter pickup stick.

6. The apparatus as recited in claim 5 wherein said elongated housing is generally rectangular in cross-sectional area with said open lower end being generally rectangular.

7. The apparatus as recited in claim 6 further comprising a gate pivotally mounted parallel to said springs near a mid-portion of and to one side of said elongated housing, an abutment to prevent pivoting or said gate below a first plane generally parallel with a second plane containing said springs, said gate allowing said elongated housing to be filed with said beverage cons or bottles or separating said litter picked up with said litter pickup stick from said beverage cans or bottles.

8. The apparatus as recited in claim 7 wherein said holder means includes a clip connected to said elongated housing near said open upper end thereof for clipping to said litter pickup stick and a horizontal plate with a hold therein connected to said elongated housing near said open lower end thereof, a sharp projection of said litter pickup stick extending through said hold during periods of non-use of said litter pickup stick.

* * * * *